US005669737A

United States Patent [19]

Équilbec et al.

[11] Patent Number: 5,669,737

[45] Date of Patent: Sep. 23, 1997

[54] WALL RETENTION SYSTEM

[76] Inventors: Michel Équilbec, 124, rue Biron, Drummondville (Québec), Canada, J2C 2Y7; Jean Côté, 837, route 148, Masson (Québec), Canada, J0X 2H0

[21] Appl. No.: 507,884

[22] Filed: Jul. 27, 1995

[51] Int. Cl.[6] ..... E02D 5/20

[52] U.S. Cl. ..... 405/262; 405/284; 405/303

[58] Field of Search ..... 405/262, 284, 405/303

[56] References Cited

U.S. PATENT DOCUMENTS 4,514,113 4/1985 Neumann ..... 405/284 X
5,468,098 11/1995 Babcock ..... 405/262

FOREIGN PATENT DOCUMENTS 1157281 11/1983 Canada .

*Primary Examiner*—Tamara L. Graysay
*Assistant Examiner*—Tara L. Mayo
*Attorney, Agent, or Firm*—F. Martineau

[57] ABSTRACT

A wall retention system for abutting against and retaining a mass of earth, comprising in combination: (a) a set of flat facing slabs, each facing slab having an outer flat surface and an inner, reinforced surface. The facing slabs are edgewisely interlocked to form a single continuous wall structure. Foundation slabs abut on the ground, and support the lower portions of the facing slabs wherein the facing slabs are supported in generally upright condition. A number of elongated brace bars are provided, integrally carried at their inner ends by the facing slabs reinforced surface and transversely projecting therefrom at vertically spaced intervals. These tension members embeddingly anchor into the mass of earth to be retained. Hence, large horizontal loadings from the mass of earth can be sustained by the wall retention system, without compromising the angularity of the facing slabs relative to ground level.

6 Claims, 6 Drawing Sheets

WALL RETENTION SYSTEM

FIELD OF THE INVENTION

This invention relates to wall retention systems used for controlling horizontal loads.

BACKGROUND OF THE INVENTION

Canadian patent No 1,157,281 issued 22 November 1983 to Edmond BALZER discloses a wall retention system comprising a number of facing slabs arranged in general upright fashion over a hollow foundation slab. The upright facing slabs wall transversely carry integral upright ribs. The lower end portion of the facing slabs are notched, wherein metallic elbowed reinforcing rods project therefrom. The hollow foundation slab also integrally carries inwardly projecting reinforcing metallic rods. By pouring uncured cement into the hollow of the foundation slab, and then allowing the cement to set, the concrete base and upright wall become integrally interconnected.

Such wall retention systems are acceptable for controlling a number of horizontal loads. However, when the tilt loads applied on the upright wall are high or very high, particularly at the upper section of the wall, then the foundation anchoring alone may not be sufficient to continuously withstand these extreme loads.

OBJECTS OF THE INVENTION

An important object of the invention is to improve upon the wall retention system as disclosed in Canadian patent No 1,157,281, supra .

A corollary object of the invention is to increase the horizontal load controlling capability of existing upright wall retention systems.

A further object of the invention is to provide such a wall retention system which will consist of factory made, modular components, wherein installation thereof can be done quickly and inexpensively by semi-skilled workers.

SUMMARY OF THE INVENTION

The present wall retention system includes factory made, precast modular components, enabling the erection of generally upright (vertical or inclined) walls that must support transverse stress and transfer it to the foundation system. Full height facing slabs are laid side by side on foundation slabs. A cast-in-place footing is then set, assuring a perfect embedding of the components. Hence, the precast reinforced concrete element is self-standing after putting it on the concrete base. The interior side of the facing slabs carry upright reinforcing ribs, while the exterior side of the facing slabs is continuous. The present wall retention system can be made to order: choice of model and height, and the framework is adapted to the dimensions of the project and determined by the (mainly) horizontal stress loadings to be contained. The final concreting in the trench is done last, the modular wall components being monolithically bonded.

More particularly, and in accordance with the objects of the invention, there is disclosed a wall retention system for abutting against and retaining a mass of earth, comprising in combination: (a) a set of flat facing slabs, each said facing slab having an outer flat surface and an inner, reinforced surface; (b) interlocking means, for interlocking said facing slabs to form a single continuous wall structure; (c) foundation slabs, adapted for ground engagement, and defining integral means for supporting and anchoring the lower portions of said facing slabs wherein said facing slabs are supported in generally upright condition; and (d) a number of elongated tension members, integrally carried at their inner ends by said facing slabs reinforced surface and transversely projecting therefrom at vertically spaced intervals, said tension members adapted to embeddingly anchor into said mass of earth to be retained; wherein large horizontal loadings from the mass of earth can be sustained by said wall retention system, without compromising the angularity of said facing slabs relative to ground level.

In a first embodiment of the invention, each of said elongated tension members includes: (a) first and second straight, elongated brace bars, defining inner and outer ends; (b) bracket means, fixedly anchoring said inner ends of said straight brace bars to laterally offset raised sections of said reinforced surface of facing slabs; and (c) third arcuate brace bar, fixedly interconnected by bolt means to said outer ends of said first and second straight brace bars, with the convex side of said arcuate brace bar extending away from said facing slabs; wherein said first to third brace bars are installed to the facing slabs before a trench adjacent the retaining wall is filled with said mass of earth.

In this first embodiment, the facing slabs reinforced surface preferably define generally upright integral ribs in laterally spaced fashion; and said bracket means includes a pair of elbowed iron bars, each having a main portion, embedded into said ribs and facing slabs, and an outer free portion, wherein said iron bars outer free portions take in sandwich the inner end of a given said straight brace bar and are fixedly anchored thereto by bolt means. Different assemblies of said first to third brace bars may be anchored in vertically spaced fashion to said facing slabs, the overall horizontal component length of such brace bar assemblies decreasing with the depth thereof inside the mass of earth.

Preferably, these brace bars will extend generally orthogonally to the facing slabs outer surface.

In a second embodiment of the invention, each of said elongated tension members may include: (a) an elongated straight rigid rod, defining inner and outer ends; (b) bracket means, adjustably anchoring said inner end of said straight rod to a raised section of said reinforced surface of facing slabs; and (c) helicoidal blade means, carried by a section of said outer end of straight rod; wherein said elongated rod is to be driven through said mass of earth before the facing slabs are erected, with said helicoidal blade means facilitating through motion of said rod into the earth, without the need for previous earth trenching adjacent the retaining wall.

In this second embodiment, said rigid rod is preferably cylindrical, with said outer end thereof forming a bevelled, sharpened tip. Said facing slabs reinforced surface could also define generally upright integral ribs in laterally spaced fashion; and wherein said bracket means includes a pair of elbowed iron bars, each having a main portion, embedded into said ribs and facing slabs, and an outer free portion, wherein said iron bars outer free end portions engage a flange member which thus becomes anchored to said rib, said flange member having a bore; further including a hook member, releasably engaging said flange member bore, and a turnbuckle member, adjustably interconnecting said hook member to said rod inner end.

In either ones of the above-noted first and second embodiments, said integral supporting means of the foundation slabs may preferably include first straight iron bars, integral to said foundation slabs and extending transversely relative to said facing slabs outer surface; and wherein the lower edge portion defined by said facing slabs is notched, with second elbowed iron bars integrally projecting downwardly from said facing slabs notch, wherein said first and second iron bars come in substantially horizontal register with one another; uncured cement being poured into the hollow of said foundation slabs and allowed thereafter to set, so as to integrally interconnect said first and second iron bars.

Preferably, these tension rods will extend in downwardly inclined fashion from the facing slabs.

DETAILED DESCRIPTION OF THE EMBODIMENTS OF THE INVENTION

Figure 1:
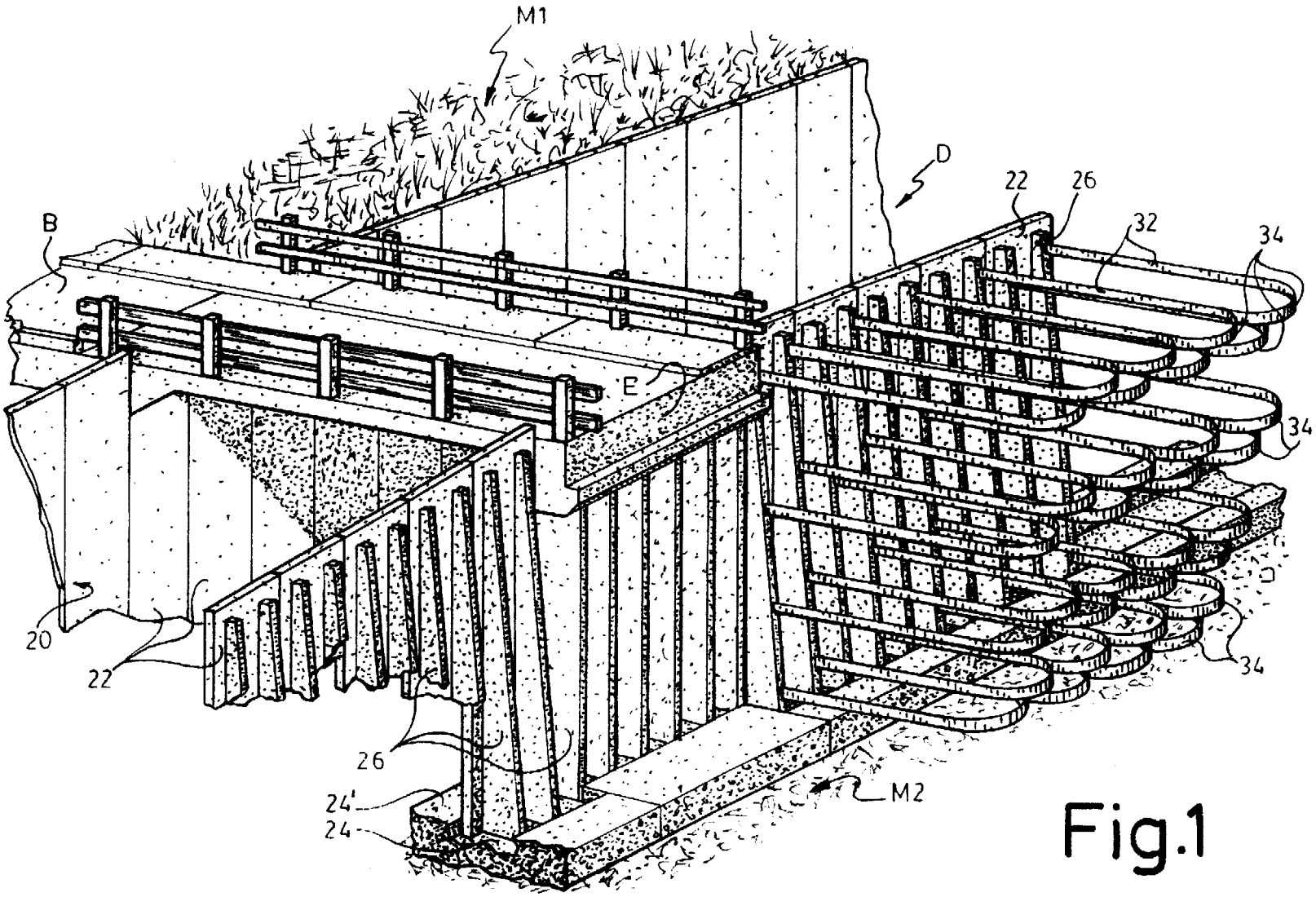
FIG. 1 is a perspective view of a motor vehicle bridge spanning two opposite earth abutment wall members according to a first embodiment of the invention, one of these wall members being in partially fragmentary view.

In FIG. 1, a bridge B spans a ditch D separating two horizontally spaced earth masses M1 and M2. Against the vertical or inclined wall portion of each earth mass M1 and M2 that faces the ditch D, there is mounted an abutment wall member 20. Each abutment wall member 20 prevents the corresponding adjacent earth mass M1 or M2 from moving toward one another and from filling the ditch D, and more to the point, ensures firm footing for the bridge B, for maintaining the horizontally thereof.

Figure 2:
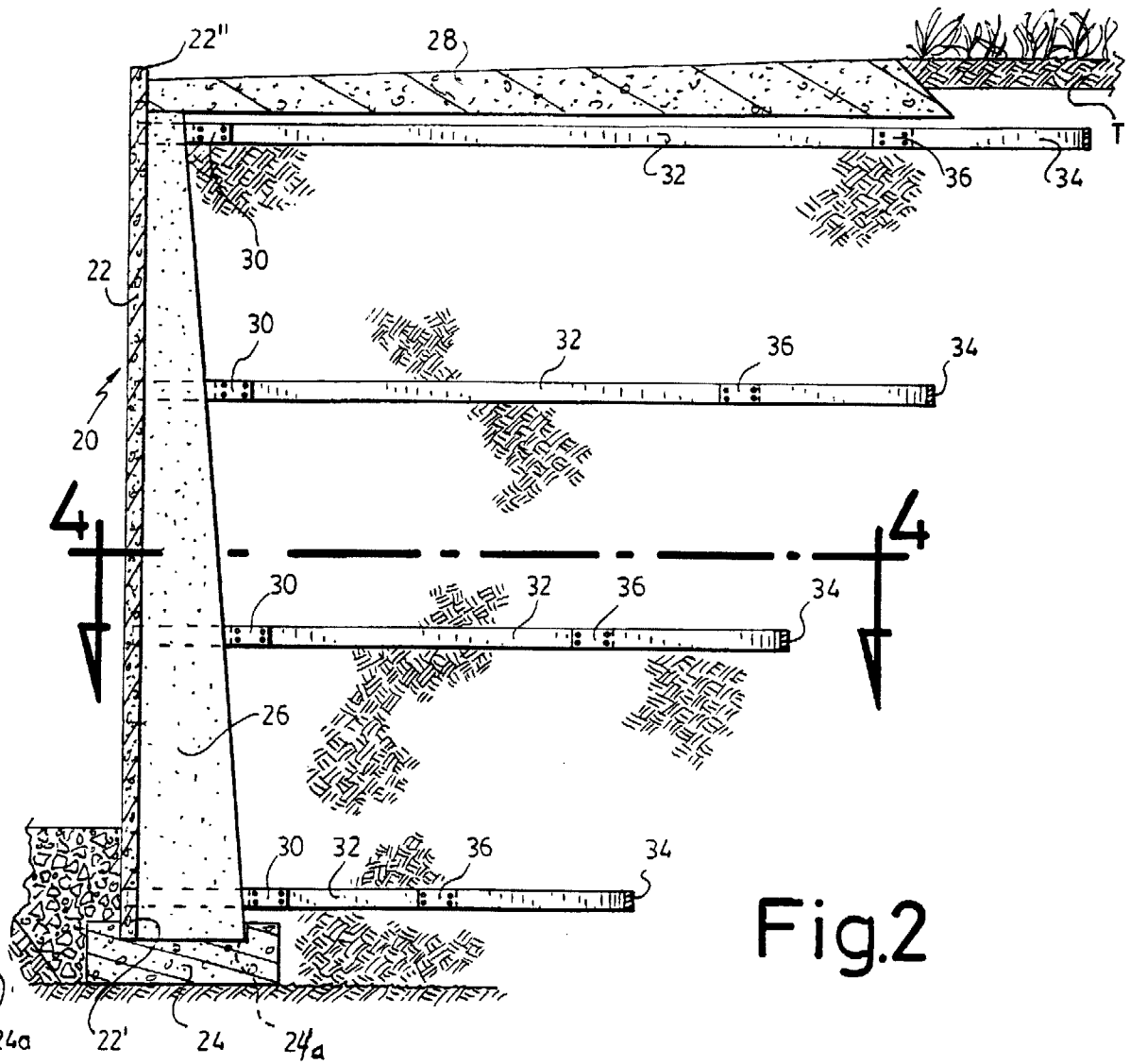
FIG. 2 is a side elevation, at an enlarged scale, of a first embodiment of abutment wall member.
Figure 4:
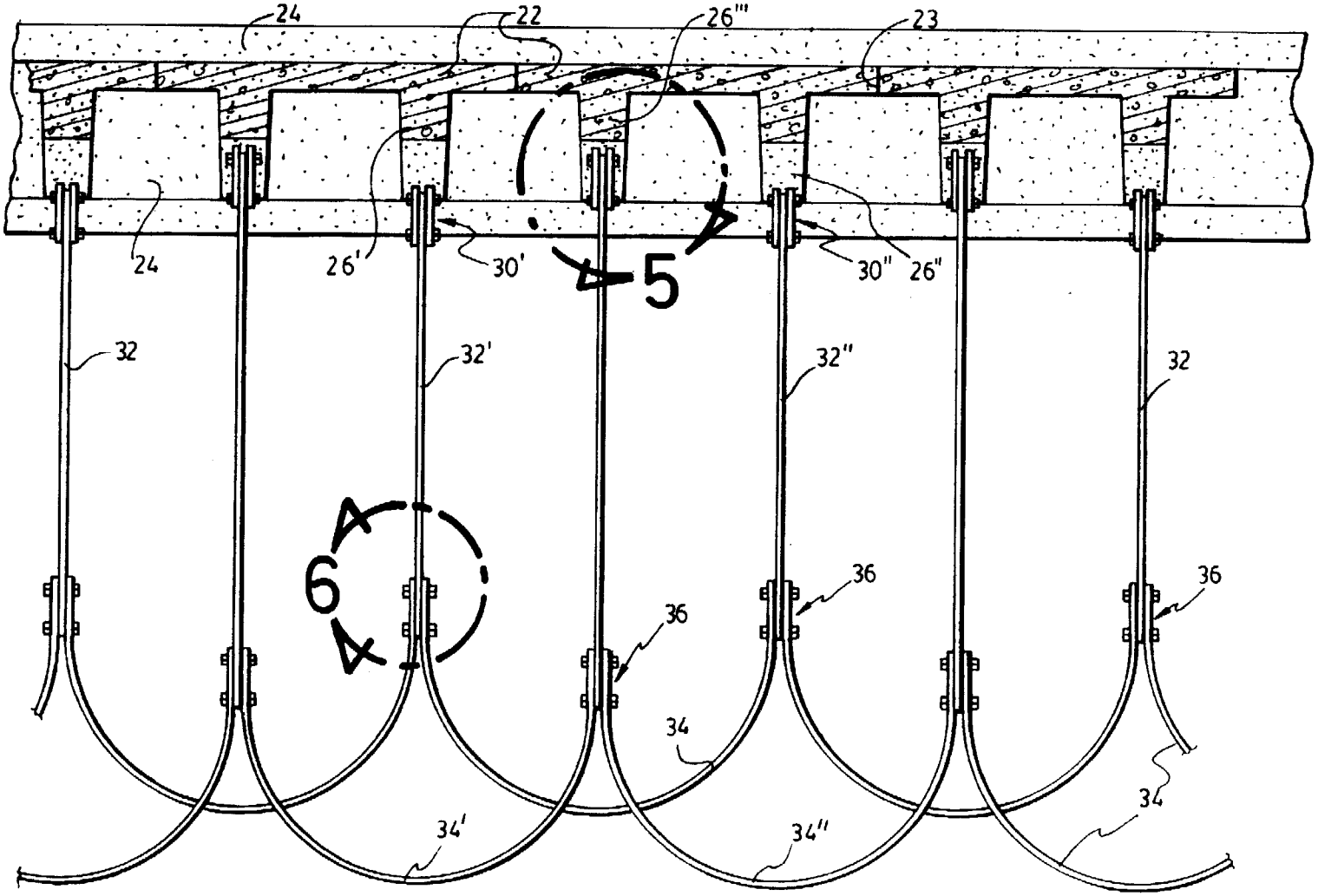
FIG. 4 is a cross-sectional view at an enlarged scale taken along line 4—4 of FIG. 2.
Figure 9:
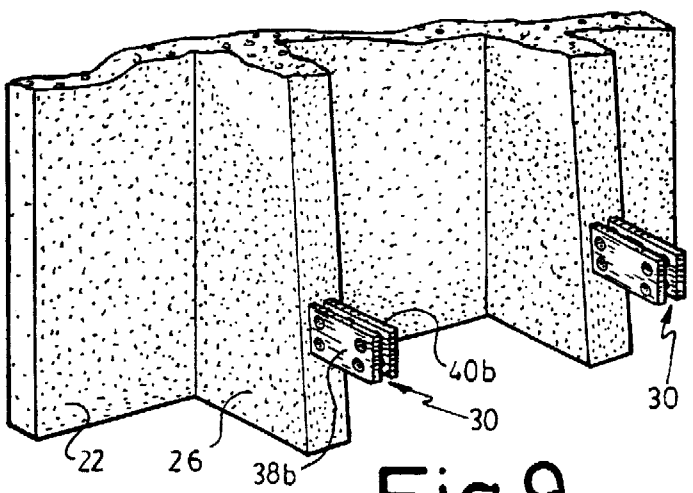
FIG. 9 is a broken perspective view of the elements of FIG. 5.

A first embodiment of abutment wall member is illustrated in FIGS. 2 and 4 to include a set of upwardly extending, sidewisely disposed, facing slabs 22, forming a continuous, generally upright earth retaining panel. The bottom slab 22' is supported over ground by engagement into a complementary cavity 24*a* of a horizontal foundation slab 24. The facing slabs 22 simply rest by their own weight into the foundation slab cavity 24*a*, with uncured cement poured thereon and allowed to set before use.

By "generally upright" in relation to the facing slabs 22 of the present wall retention system 20, there is meant that the retention wall be either vertical, or be inclined with its main vectorial component being vertical.

The facing slabs 22 are edgewisely interlocked in successive sidewise pairs by suitable anchoring means, such as respective edgewise tenon and mortise joints 23, which are thereafter bonded by suitable bonding means. Such bonding means may bring watertight interconnection between the facing slabs, a prerequisite in water containing basin projects. Upwardly tapering integral ribs 26 upwardly extend along the interior face (i.e. on the side opposite ditch D) of the generally upright retaining panel 20. A surface slab 28 is edgewisely carried by the top slab 22" and extends interiorly from retaining panel 22, to eventually merge with ground level turf T. Each upright rib 26 carries a few vertically spaced inturned brackets 30, from each of which interiorly projects an elongated straight brace strip 32. The brace strips 32 are destined to be embedded into the earth mass M1 and M2. The length of the brace strips 32 may be of the order of magnitude of the height of the upright retaining slabs 22, to ensure strong earth anchoring of the retaining panel 20 in its upright condition.

As suggested in FIG. 4, the straight brace strips 32', 32", of each pair of approximately same horizontal level brackets 30', 30", respectively, are fixedly interconnected at their outer ends (further away from slabs 22) to an additional arcuate elongated brace strip 34, via attachment means 36. Obviously, the convexity of arcuate brace strips 34 should be directed away from the facing slabs 22, to extend to the fullest the reach of earth mass anchoring strip assembly 32, 34. For example in FIG. 4, the brace strips 32', 32", of a given pair of brace strips may be anchored to brackets 30', 30", from a given rib 26'and from a second successive rib 26", respectively, that is, with a free intermediate rib 26'" therebetween, to provide a greater horizontal gap between bracket strips 32' and 32". Preferably also, each attachment means 36 interconnects the ends of a pair of adjacent arcuate brace strips 34', 34".

In FIG. 2, the U-shape brace strips 32, 34, are shown to be orthogonal to the facing slabs 22 and generally parallel to ground level. Although this arrangement is preferred, it is understood that other transverse angular relations between U-shape brace members 32, 34, and facing slabs 22 in relation to ground level, for example, upwardly outwardly inclined brace members 32, 34, or downwardly outwardly inclined brace members, are not excluded from the scope of the present invention.

As suggested in FIG. 2, the length of the straight brace strips 32 will preferably be made to increase from the bottom to the top portions of the facing slabs 22, to reflect earth movement loads at different depth levels. The top (ground level) brace strip 32 will then have the longest length, being of a length for example approximately equal to that of the height of the vertically staggered upright facing wall slabs 22. Brace strips 32 provide tensioning resistance to wall 20, to fight horizontal loadings applied there against.

Figure 8:
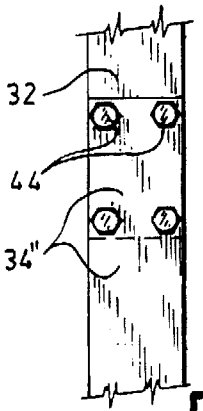
Figure 5:
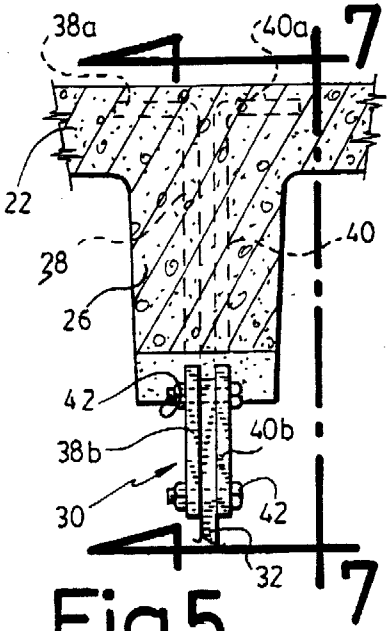
FIGS. 5 and 6 are enlarged views of the areas circumscribed by arrows 5 and 6, respectively, of FIG. 4.
Figure 6:
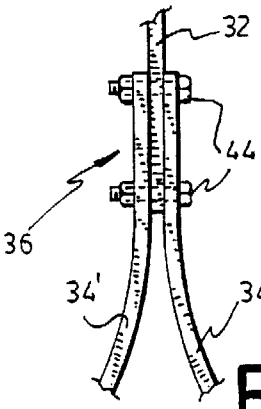

FIGS. 5, 7, and 9–10 detail the structure of anchoring brackets 30, while FIGS. 6 and 8 detail the structure of attachment means 36. Each bracket 30 includes a pair of L-shape bracket plates 38, 40, with their main portion being embedded into a corresponding rib 26, their elbowed section 38*a*, 40*a*, being further embedded in opposite directions into the registering facing slab 22. The free outer end portions 38*b*, 40*b*, (i.e., farthest away from facing slabs 22) of bracket plates 38, 40, are made to abut against opposite lateral sides of the inner end portion of brace strip 32, and are taken in sandwich there against and locked thereto by number of bolts 42 joining the three structural elements 38, 40 and 32.

Attachment means 36 simply consists of the outer end portion of straight brace strip 32 (i.e. farthest away from facing slabs 22) being taken in sandwich between the registering end portions of two successive arcuate brace strips 34', 34", by a number of anchoring bolts 44 extending through the three elements 32, 34' and 34".

As suggested by the right hand side part of FIG. 2, it is understood that the earth mass M1 or M2 into which brace elements 32 and 34 are to extend, have to be previously excavated, to remove earth behind the erected facing slabs 22, before such elongated brace elements 32 and 34 can be installed. Accordingly, the upright facing slabs 22 will be self-standing for a while. Thereafter, earth can be brought behind the erected slabs 22 to fill the interior side area of the retaining wall 22, whereby the brace elements 32 and 34 will progressively become embedded into the thus formed earth mass, as the trench is progressively filled with earth.

Figure 3:
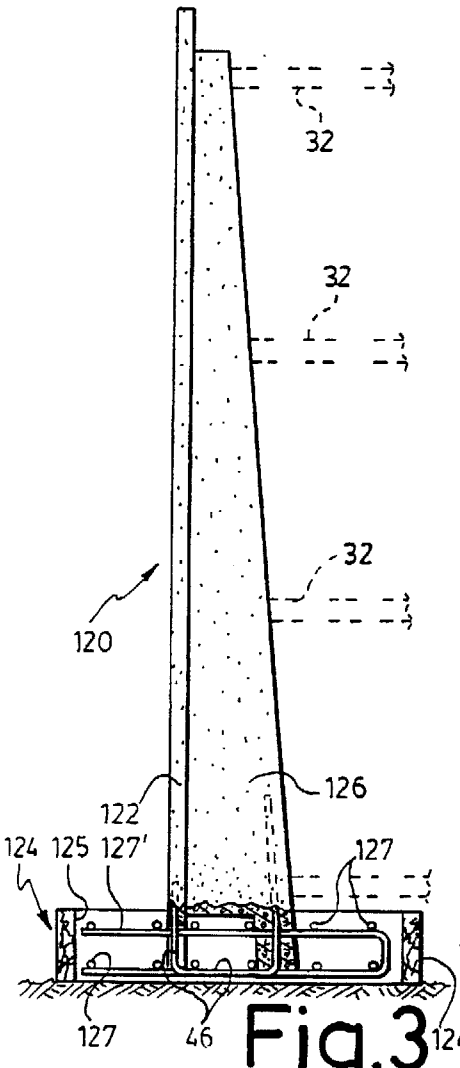
FIG. 3 is a side elevation of a second embodiment of abutment wall member, with the brace member shown in phantom lines.
Figure 10:
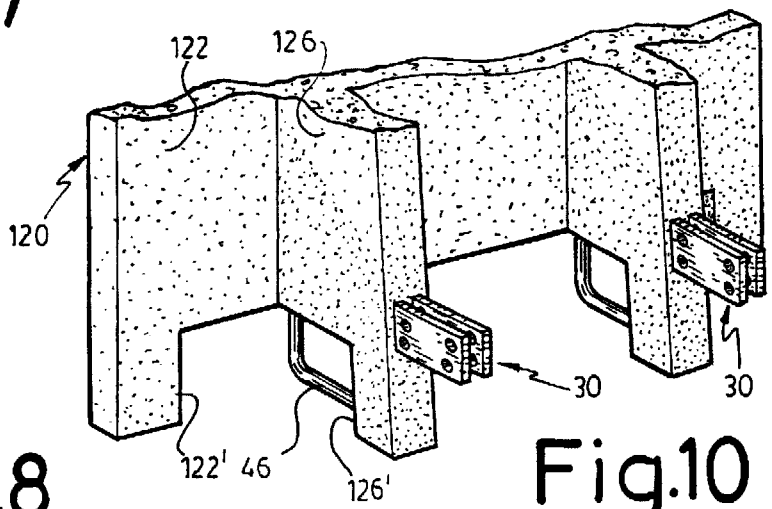
FIG. 10 is a view similar to FIG. 9, but showing the bottom portion of the retaining wall facing slabs according to the embodiment of FIG. 3.
Figure 7:
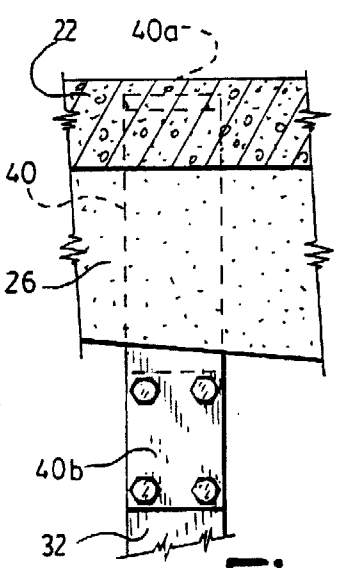
FIGS. 7 and 8 are views of the elements of FIGS. 5 and 6, respectively, being rotated by a quarter of a turn relative thereto.

In the alternate embodiment of retaining wall 120 illustrated in FIGS. 3 and 10, the lowermost facing slab portions 122 and bottom end portions of upright interior ribs 126 are notched at 122', 126', to accommodate angled iron bars 46 which extend downwardly from the ribs 126. The foundation slab 124 is cavityless, but rather includes a main through-aperture 125, wherein other stainless steel reinforcing rods or iron bars 127, 127' also project from the side walls 124*a*integrally of the foundation slab 124 and transversely crossing one another and crossing the horizontal components of the adjacent rib reinforcing rods 46.

In the embodiment of FIGS. 3 and 10, uncured cement is poured into hollow foundation slab cavity 125, where the concrete is allowed to set before use so as to fixedly interconnect slabs 122, ribs 126 and foundation slab 124*a*by their respective steel anchor rods 46, 127, 127'.

Figures 11, 12:
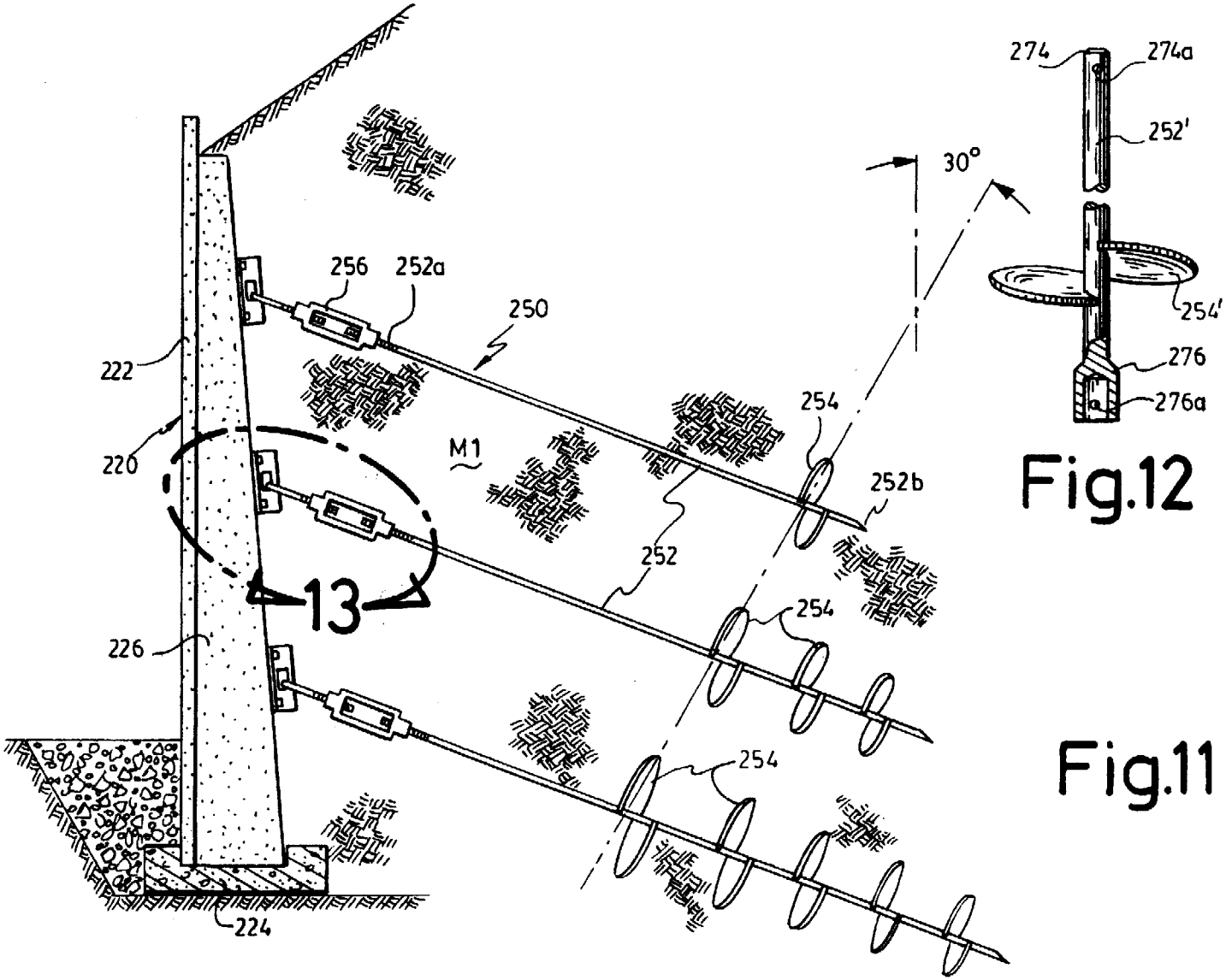
FIG. 11 is a view similar to FIG. 2, but showing another embodiment of wall retention system.
FIG. 12 is an enlarged, partly sectional, plan view of a brace anchor rod extension modular extension, forming part of the wall retention system of FIG. 11, and carrying a single turn helicoidal blade according to the invention.
Figure 14:
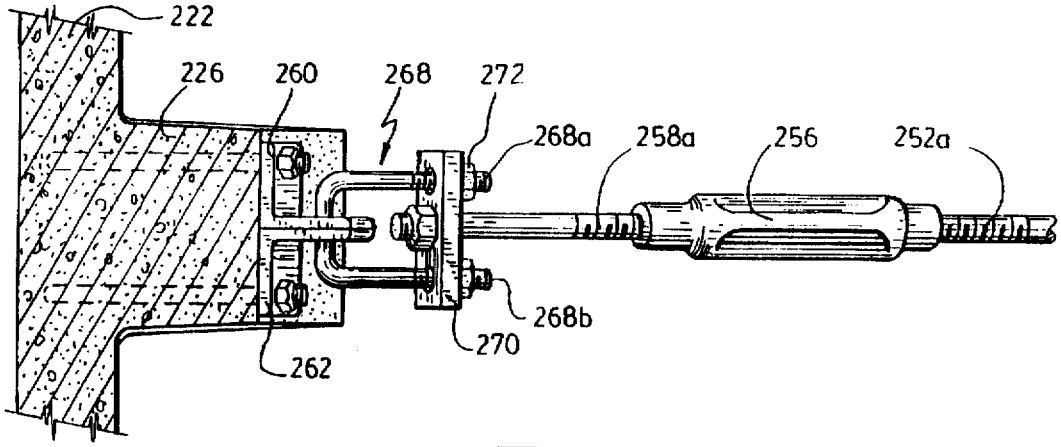
FIG. 14 is a sectional view of the turnbuckle attachment, taken along line 14—14 of FIG. 13.
Figure 13:
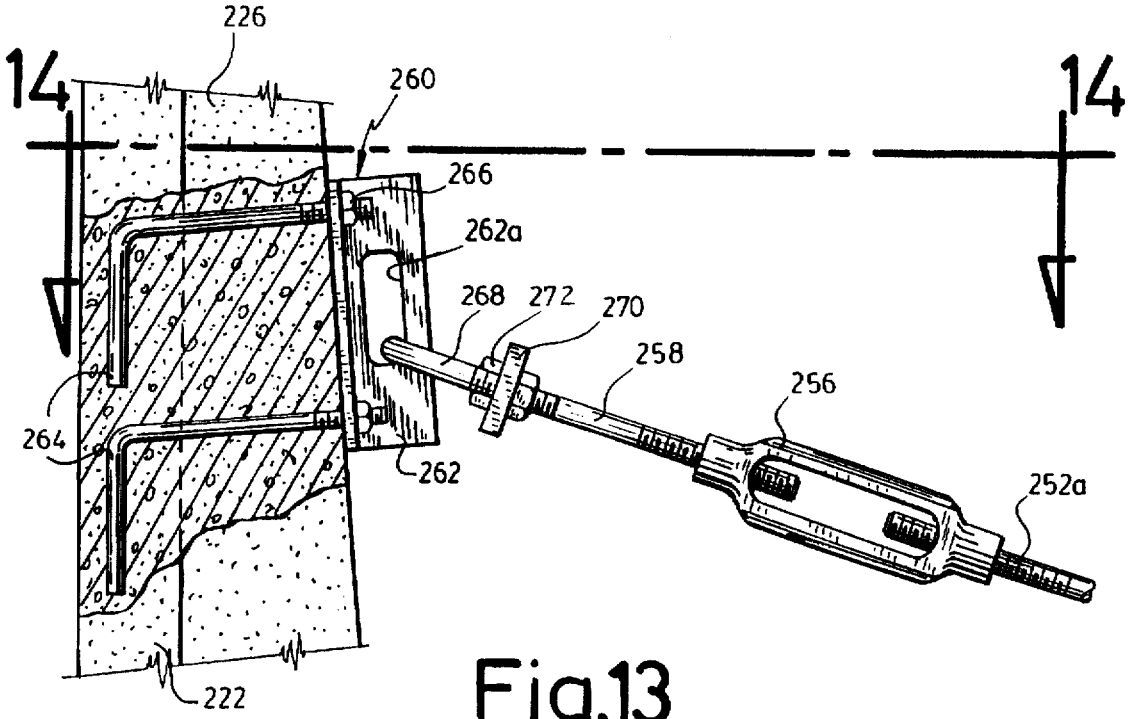
FIG. 13 is a partly sectional, enlarged view of the area circumscribed by arrow 13 in FIG. 11, showing the turnbuckle attachment of the brace anchor rod.

The last embodiment of retaining wall assembly is shown as 220 in FIG. 11, with the components thereof detailed in FIGS. 12 to 14. The facing slabs 222, interior upright ribs 226 and foundation slabs 224 are identical to those of the first embodiment 20; however, the brace strips (32 and 34) are replaced by rigid anchor rod members 250. Each anchor rod member 250 includes an elongated cylindrical rod 252, with a threaded end portion 252*a*at its inner end (proximate upright retaining panel 220), and at least one—and preferably a few lengthwisely spaced—single turn helicoidal blade(s) 254 integrally carried at its outer end portion. The outer end tip 252*b* of each rod 252 is bevelled and sharpened, to facilitate drive through engagement thereof into earth mass M1 or M2. Single turn helicoidal blades 254 must be of a type adapted to promote screw driving action of the rods 252 into earth, to facilitate their axial through-engagement into the earth masses M1 or M2. The threaded rod portion 252*a* is threadingly engaged by a turnbuckle 256, which also threadingly engages at its opposite end the threaded stem 258*a* of a hook member 258. Hook member 258 is in turn releasably engaged with a bracket member 260 integrally anchored to the vertical rib 226 of the retaining wall 220. Hence, by rotating the main body of turnbuckle 256, stem portions 258*a* and 252*a* are brought axially toward one another, thus tightening the traction of earth embedded anchor rod 252 applied to retaining wall 220. Release of rod 252 from wall 220 can be obtained by unscrewing turnbuckle 256, which will detach stem portions 252*a* and 258*a* from one another.

As shown in FIGS. 13 and 14, bracket member 260 includes a T-shape flange 262, being applied flatly against the interior edge of wall rib 226, and a number of L-shape anchor bolts 264, 264, driven through rib 260 with their elbowed legs extending through the registering facing slabs 222 and anchoring the flanges 262 to the rib 226 with nuts 266. T-shape flange 262 includes a ovoidal bore 262*a*transverse to rib 226.

Hook member 258 consists in turn of a U-shape rod 268, releasably engaging ovoidal bore 262*a* of the bracket T-flange 262. The two threaded ends 268*a*, 268*b*, of U-shape rod 268 threadingly engages threaded bores made at opposite ends of a straight coupling bar 270, and are releasably locked thereto by nuts 272. The threaded end portion of stem portion 258*a* opposite turnbuckle 256 threadingly engages a section of coupling bar 270 intermediate the two legs of U-rod 268, and is locked therein by another nut 272.

FIG. 12 shows an anchor rod extension member, 252', being provided with a single turn helicoidal blade 254'. One (or more) rod extensions 252' are adapted to axially fit to one another, so as to adjustably vary the overall length of a given anchor rod member 250. To that effect, rod extension 252'includes a male coupling end part 274, diametrally the same as the main body of cylindrical rod extension 252', and a female coupling end part 276, being diametrally enlarged and defining a socket having an inner diameter complementary to that of the male coupling end part 274 of the rod member 252. Coupling end parts 274 and 276 each has a transverse bore 274*a*, 276*a*, for releasable through engagement by a set screw (not shown) for releasably interconnecting the rod extensions 252'to the rod proper, 252, axially to one another.

In the retaining walls, facing slabs 22, 122, 222, including upright ribs 26, 126, 226, as well as foundation slabs 24, 124, 224, and surface slabs 28, should be of the precast make, preferably from concrete, although other suitably strong materials would not be excluded from the scope of the invention, particularly, strong plastic materials, metallic alloys such as stainless steel, reinforced aluminum, and the like.

It is to be understood that the iron bars 46, 127, 127', as well as iron bars 38, 40, and 264, 264, should all be preferably made from some sturdy weatherproof material, preferably reinforced stainless steel.

As suggested in FIG. 1, the transverse end beams E of the bridge B should extend interiorly beyond the top edge of the facing slabs 22, so as to be able to sink beneath the top edge of the retaining wall ribs 26, wherein the upper portions of these ribs will positively retain the corresponding transverse end beams E against accidental motion into the ditch D.

Clearly, a variety of applications other than bridges B are envisioned to benefit from the present retaining wall assembly, for example:

- for water retention projects: the application range of the present invention is most varied on water retention projects; indeed, the design allows the realization of round basins starting from a diameter of six meters and more, for example, for the treatment of waste water; of rectangular tanks, and the like; applications include: water protective barriers, drinkable water reservoirs, and private swimming pools;
- as wharf walls for fluvial harbour: in this application, the retaining wall is used in sailing harbours, commercial ports for barges and protection of river banks; not excluded are alluvial dams particularly studied for laying by helicopter;
- as walls for docks of commercial building;
- as lower ground floors: the present wall retention system can be used in the lower ground floors of building, for peripheral walls that retain the ground and support intermediate floors; it is feasible, with this type of retention wall, to work a small portion at a time, in order to prevent eventual caving in from adjoining areas;

as basement of villas;

as retaining walls under a railroad, submerged by aquifer sheet;

as a wall with shifted footing;

as a sound barrier; and other applications are also envisioned.

It is noted that, on account of the upright ribs, the whole wall structure is therefore continuous, and does allow a retake of the horizontal loading stress from the top.

We claim:

1. A wall retention system having precast modular components, for abutting against and retaining a mass of earth, comprising in combination:

(a) a set of flat facing slabs, adapted to interlock with one another to form a single continuous wall structure, each said facing slab having an outer flat surface and an inner, reinforced surface;

(b) interlocking means, for sidewisely interlocking said facing slabs to form said single continuous wall structure;

(c) foundation slabs, adapted for ground engagement, and defining integral means for supporting and anchoring the lower portions of said facing slabs wherein said facing slabs are supported in generally upright condition;

(d) a number of sets of elongated tension members, each of said sets of tension members having at least three vertically spaced tension members integrally carried at their inner ends by the same single corresponding said facing slab reinforced surface and transversely projecting therefrom at vertically spaced intervals, said tension members adapted to embeddingly anchor into said mass of earth to be retained;

wherein each of said elongated tension members includes:

(a) first and second straight, elongated brace bars, defining inner and outer ends;

(b) bracket means, fixedly anchoring said inner ends of said first and second straight brace bars to laterally offset raised sections of said reinforced surface of facing slabs; and (c) a third arcuate brace bar, fixedly interconnected by bolt means to said outer ends of said first and second straight brace bars, with the convex side of said arcuate brace bar extending away from said facing slabs;

wherein said first to third brace bars are installed behind the facing slabs within a trenched earthless area;

wherein said third arcuate brace bars of laterally adjacent sets of tension members are fixedly interconnected in successive lateral pairs of third arcuate brace bars by the same said bolt means, so that all said sets of tension members are accordingly interconnected in successive pairs at their outer ends wherein an integral massive open ground anchoring array is formed;

wherein large horizontal loadings from the mass of earth can be sustained by said wall retention system, without compromising the angularity of said facing slabs relative to ground level.

2. A wall retention system as defined in claim 1, wherein said facing slabs reinforced surface define generally upright integral ribs in laterally spaced fashion; and said bracket means includes a pair of elbowed iron bars, each having a main portion, embedded into said ribs and facing slabs, and an outer free portion, wherein said iron bars outer free portions take in sandwich the inner end of a given said straight brace bar and are fixedly anchored thereto by bolt means.

3. A wall retention system as defined in claim 1, wherein said vertically spaced tension members are of decreasing length with the depth thereof inside the mass of earth.

4. A wall retention system as defined in claim 3, wherein each of said brace bars is cross-sectionally rectangular, to enhance earth embedding and loading resistance of the wall retention system.

5. A wall retention system as defined in claim 1, wherein said integral supporting means of the foundation slabs include first straight iron bars, integral to said foundation slabs and extending transversely to said facing slabs outer surface; and wherein the lower edge portion defined by said facing slabs is notched, with second elbowed iron bars integrally projecting downwardly from said facing slabs notch, wherein said first and second iron bars come in substantially horizontal register with one another;

wherein uncured cement is to be poured into the hollow of said foundation slabs and allowed thereafter to set, so as to integrally interconnect said first and second iron bars.

6. A wall retention system as defined in claim 1, wherein said brace bars extend generally orthogonally to said facing slabs outer surface.

* * * * *